United States Patent [19]

Artiano et al.

[11] 4,147,620

[45] Apr. 3, 1979

[54] METHOD AND APPARATUS FOR SORTING CONTAMINANT MATERIAL FROM PROCESSING MATERIAL

[75] Inventors: Adrian Artiano, Everett; Darrell H. Halgrimson, Edmonds; Henry W. Joselovitz, Marysville, all of Wash.

[73] Assignee: Black Clawson Inc., Everett, Wash.

[21] Appl. No.: 807,721

[22] Filed: Jun. 15, 1977

[51] Int. Cl.[2] ..... B07C 5/00

[52] U.S. Cl. ..... 209/590; 209/941

[58] Field of Search ..... 209/73, 74 R, 74 M, 209/79, 111.9; 73/552, 555, 556, 557

[56] References Cited

U.S. PATENT DOCUMENTS

| | | | |
|---|---|---|---|
| 3,127,016 | 3/1964 | Baigent | 209/74 |
| 3,394,806 | 7/1968 | Vaillette | 209/111.9 |

FOREIGN PATENT DOCUMENTS

| | | | |
|---|---|---|---|
| 1125740 | 3/1962 | Fed. Rep. of Germany | 209/111.9 |
| 2506212 | 8/1975 | Fed. Rep. of Germany | 209/79 |

*Primary Examiner*—Allen N. Knowles

*Attorney, Agent, or Firm*—Biebel, French & Nauman

[57] ABSTRACT

A contaminant sorting device for sorting contaminant material such as metal and rocks from process materials such as wood chips which are intended to be subsequently processed, comprises a material receiving surface upon which a layer of material is deposited which material contains both contaminant and process material, an impact sensing device for sensing vibrations of the material receiving surface upon impact of the material thereon, an electronic circuit for distinguishing between signals generated by impact of contaminant material from signals generated by impact of process material and for providing an output signal in response to receipt of a contaminant material signal, a flow diverting plate downstream from the material receiving surface which is activated by the signal produced in response to impact of the contaminant material so that the normal flow path of the layer of material is interrupted so as to divert that portion of material containing contaminant material to a separate receptacle, and time delay means for deactivating the flow diverting plate so as to return the subsequent layer of material to its normal flow pattern.

13 Claims, 6 Drawing Figures

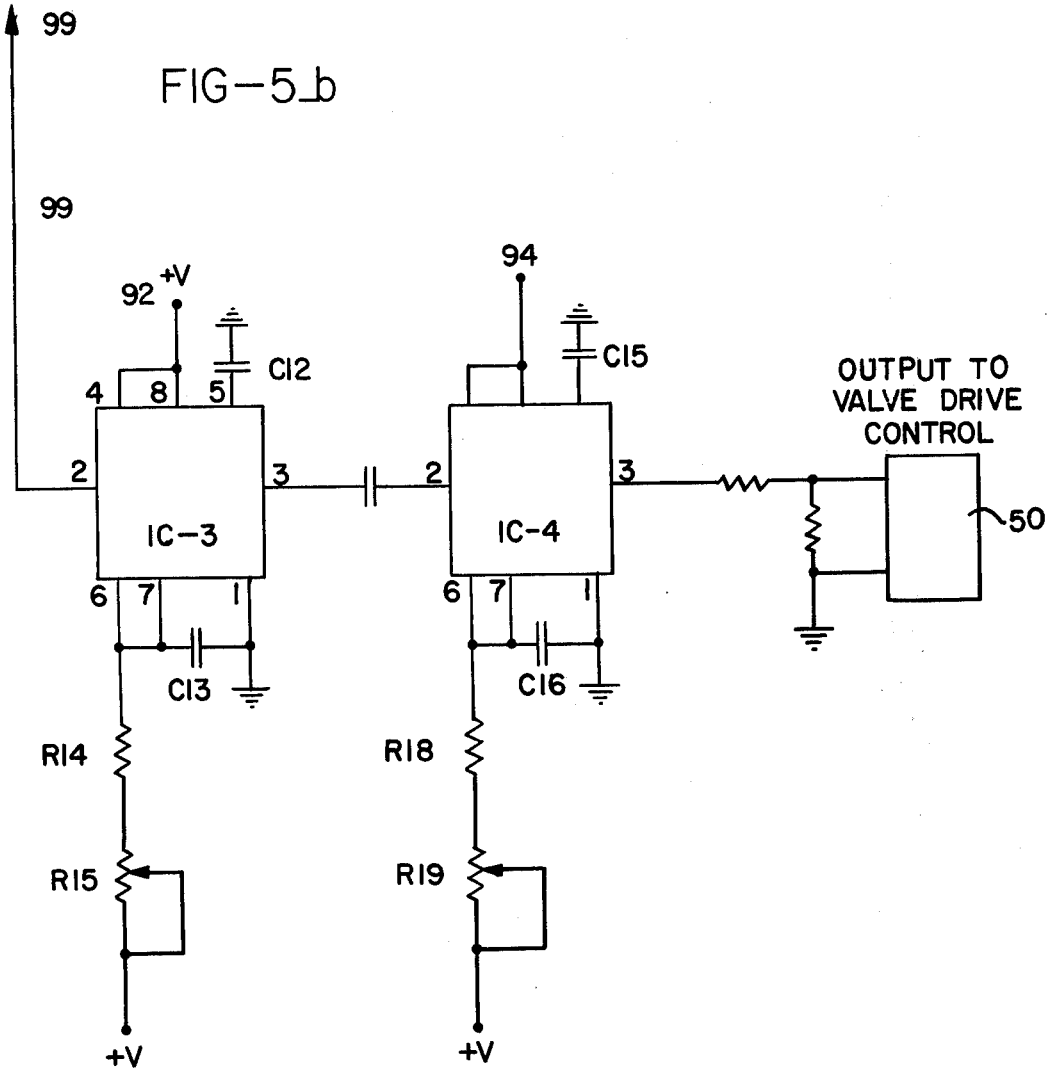
99
FIG-5_b
99
92
+V
C12
4
8
5
2
3
IC-3
6
7
1
C13
R14
R15
+V
94
C15
2
3
IC-4
6
7
1
C16
R18
R19
+V
OUTPUT TO
VALVE DRIVE
CONTROL
50

METHOD AND APPARATUS FOR SORTING CONTAMINANT MATERIAL FROM PROCESSING MATERIAL

BACKGROUND OF THE INVENTION

1. Field of the Invention

The present invention relates to contaminant sorting devices, and more particularly, to a method and apparatus for sorting contaminant material such as metal and rocks from process material such as wood and the like.

2. Prior Art

In the wood processing industry as well as in many other similar industries, the material being processed such as wood chips is often contaminanted by material which cannot be processed, such as tramp metal or rocks. Referring specifically to the wood processing industry to which the present invention is more particularly related, it is necessary to remove this contaminant material at an early stage of the processing so as to prevent damage to machinery or production of a materially poor product.

In the wood processing industry there are many processes which involve the reduction of wood particle size by the use of equipment such as chippers, rechippers, flakers and the like, which use, for example, knives or anvils for reducing particle size of the wood chips. If relatively hard material such as rocks or tramp metal are introduced into these devices it can cause severe damage to the equipment and result in substantial processing delay due to the necessity of removing the contaminant material and possibly replacing parts in the devices.

Several means are currently used for removing metal objects from the wood material being processed, which generally incorporate magnetic sensing devices which locate metallic objects. However, such devices are ineffective for detecting rocks and similar other nonferrometallic hard objects which can cause as severe damage as the ferro-metallic objects. In the past, it has been necessary to make visual inspection of the layer of material being processed in order to remove such contaminant, making the process more expensive and susceptible of human error which often results in damage to the processing equipment due to failure to spot the contaminant material.

SUMMARY OF THE INVENTION

The present invention overcomes the above described difficulties and disadvantages associated with the use of prior art devices and methods for sensing the presence of contaminant material in process material, by providing a means and method which detects both metallic and non-metallic contaminants in a layer of material such as wood chips which is being sorted for subsequent processing.

This is accomplished by providing a material receiving surface upon which a continuous layer of material to be sorted is deposited in such a manner that it vibrates the surface. The vibrations are monitored by a sensing element which transmits the signal to a signal descriminating means which can differentiate between signals created by impact of wood chips, for example, from the impact of metal or rock objects. When the discriminating means reads a signal indicating contaminant material has been deposited on the material receiving surface, it generates a signal which in turn activates a trap door device which diverts the flow of material from its normal flow path so that the portion of material containing the contaminant material will be diverted. Once the portion of the layer of material containing contaminant material has been diverted the trap means is closed so that the layer of material subsequent to the contaminant material will again flow along the normal flow path to be collected for subsequent use.

In its preferred form, the device utilizes a flat sounding board as the material receiving surface which is sloped so that the material will slide downwardly along the surface once it is deposited thereon. A conveyor or other means is utilized to continuously deposit the layer of material on the material receiving surface. On the opposite side of the sounding board from the material receiving surface is attached a transducer which picks up the vibration due to impingement of the layer of material on the sounding board.

The signal received from the transducer is analyzed in a signal discriminating circuit which basically distinguishes in the amplitude of the signal received from the sounding board by impingement of wood chips or the like from that received when rocks or metal objects or other relatively hard material impacts the sounding board. Wood chips, particularly wet chips which have been recently cut, cause substantially less amplitude and duration of vibration of the sounding board than do metal objects or rocks. There is therefore a fairly well defined line of demarcation between the amplitudes of vibration caused by these materials which can be discerned by the electronic circuit used in the present invention.

Signals from the transducer produced by impact of wood chips on the sounding board are initially filtered out and only those signals having an amplitude of at least a predetermined threshold value will be permitted to pass further into the circuit. Signals produced by impact of rocks or metal not only have a higher amplitude but also are more prolonged than signals produced by impact of wood chips. Although, it is possible for wood chips to produce some signals of sufficient amplitude to pass through the initial filtering portion of the circuit, they do not produce the sustained series of signals to be comparable in this regard to the signals produced by rocks or metal. Therefore another portion of the circuit is designed to monitor the number of repetitions of signals having sufficient amplitude so that an output signal is only produced from that portion of the discriminating circuit if a sustained level of amplitude is reached.

Once the circuit senses the sustained level of sufficient amplitude the output signal from the discriminator circuit activates the trap door mechanism so as to divert the portion of material flow containing the contaminant material from the normal flow path of the material to the apparatus.

The trap means is preferably a flat plat disposed downstream of the material receiving surface and in the normal flow path of the material being sorted. It is hinged at its lower end so that it can be pivoted upwardly into the normal flow path of the layer of material being sorted. The plate is pivoted by means of a pneumatic cylinder positioned out of the flow path and which rotates the plate in response to a signal in the signal descriminating means indicating that contaminant material has impacted the material receiving surface.

Due to the time delay between impact of the contaminant material on the material receiving surface and the time it reaches the trap means, it is also preferable to include a time delay device which is designed to delay the time of activation of the trap means until the contaminant material has slid down the material receiving surface so that it is adjacent the trap means. Also, a time delay device is provided to hold the trap means open for sufficient time to permit the contaminant material to be removed from the flow path.

BRIEF DESCRIPTION OF THE DRAWINGS

FIGS. 5*a* and 5*b* show the control circuit for the preferred embodiment.

DETAILED DESCRIPTION OF THE PREFERRED EMBODIMENT

Figure 1:
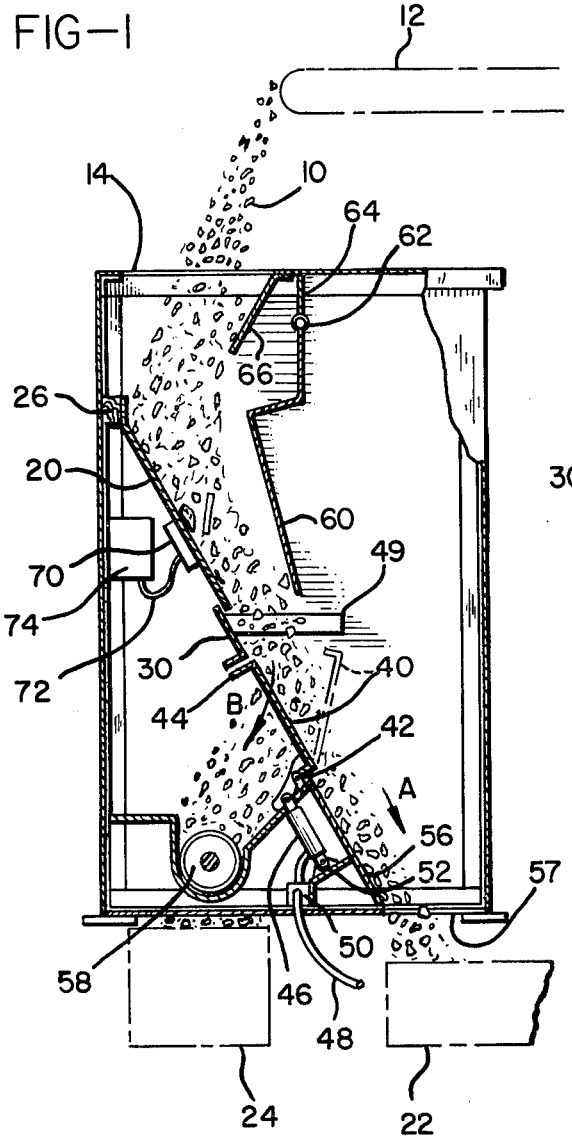
FIG. 1 is a side elevational view in cross section of a preferred embodiment of the present invention.

The preferred embodiment of the contaminant material sorting apparatus of the present invention is best illustrated in FIG. 1 wherein it is shown as it would be utilized in a material sorting process. The material 10 which is to be sorted is shown being delivered by a conveyor 12 to an opening 14 defined in the upper portion of the sorting device. The material 10 impinges upon a sounding board 20 and then flows downwardly in its normal flow path in the direction of the arrow A when there is no contaminant material in the flow of material, but is diverted in the direction of arrow B when contaminant material is present.

The preferred embodiment is designed to be utilized in the sorting of contaminant materials from wood chips and the like such as those that have come from a conventional chipping apparatus and are being further processed in the paper making process. For example, it is common to have the chips of approximately 1 ¼" long and 3/16" thick as they are received from a chipper (not shown) and sent by the conveyor 12 to the contaminant sorting device as illustrated. On the output side of the contaminant sorting device, as illustrated in FIG. 1, along the normal flow path indicated by arrow A the chips are collected in a container 22 for further use in the paper making process. If contaminant material is discovered in the flow of material it is diverted in the direction of arrow B and eventually collected in a collection box 24, either to be discarded or resorted.

Obviously, however, the contaminant sorting device can be adjusted in size to accommodate the sorting of a variety of materials other than wood chips of the sort described immediately above and therefore an explanation of the preferred embodiment used for the purpose of sorting such wood chips is not intended to be a limit on the present invention to the extent that it is operable in sorting contaminant materials from other process materials.

Referring more specifically to the details of construction of the preferred embodiment, the sounding board 20 is preferably of thin gage sheet metal and is supported at its upper end by a wooden member 26 or one made of other vibrationally insulating material. Sounding board 20 extends downwardly at an angle sufficient to permit the flow of the material 10 down the sounding board due to gravity.

Figure 2:
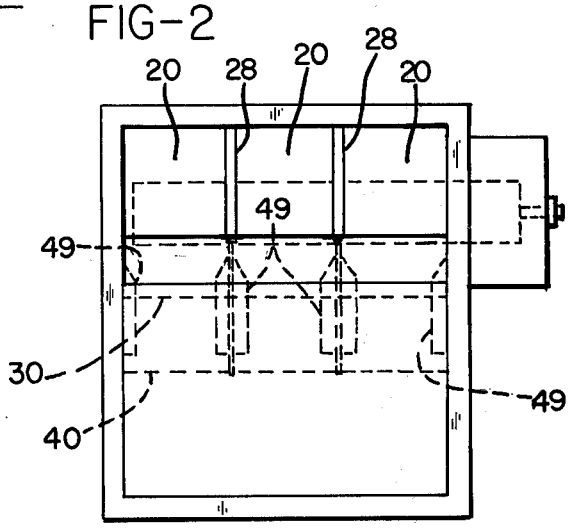
FIG. 2 is a top plan view of the embodiment of FIG. 1.
Figure 3:
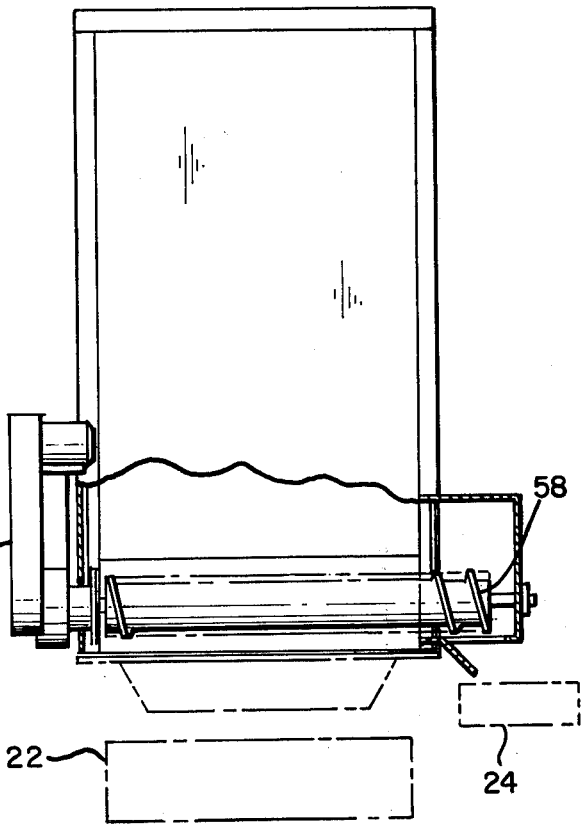
FIG. 3 is a back elevational view in partial cross-section of the embodiment of FIG. 1.

It is to be noted that a plurality of sounding boards 20 are illustrated in the preferred embodiment as best seen in FIG. 2, all of which are vibrationally insulated from one another by rubber members 28 extending therebetween and supporting their adjacent parallel edges. Any number of sounding boards 20 may be utilized depending upon the desired width of the apparatus. A plurality of such sounding boards is preferable when the material flow rate is fairly substantial since otherwise, if a single sounding board and associated trap mechanism, as described below, were utilized a substantial portion of uncontaminated material would be diverted from the normal flow path which would be unnecessary waste.

Immediately downstream of sounding boards 20 in the flow path of the material 10 is a stationary member 30 which extends across the width of the apparatus and is not in contact with the lower portion of the sounding boards so that the sounding boards are free to vibrate at their lower ends. The sounding boards 20 are positioned to overlap the member 30 so that the material 10 will not pass through the air gap between the boards and the member. Also, the position of the upper surface of stationary member 30 is parallel to sounding board 20 so that the material will continue to flow downstream due to gravity.

Immediately downstream of stationary member 30 is a trap door 40 which is pivotally secured at its lower end portion 42 for rotation between the normal flow path, as illustrated in solid lines in FIG. 1, to the diverting flow path position, as illustrated in phantom in FIG. 1. The upper edge portion 44 of trap door 40 is spaced somewhat from the stationary member 30 in the direction of the material flow path. This is important in that it prevents the trap door from becoming jammed by the material 10 when it is closing after contaminant material has been diverted. If a space were not provided the door would close on the material 10 and wedge it tightly shut so that it would not be operable, or it would prevent if from closing entirely which would disrupt the normal flow of the material.

Trap door 40 is pivotally operated by a pneumatic, double-acting cylinder 46 which moves the trap door 40 between its inoperative position in which the material 10 flows along the normal flow path A, to its operative position in which the trap door is open and the material flows along the diverting flow path B. If desired a hydraulic or mechanically operated system could be used.

With the pneumatic system of the preferred embodiment, however, a supply of air is provided through line 48 to the pneumatic cylinder and is controlled by the control circuit described below through the solenoid valve 50. Pneumatic cylinder 46 is pivotally mounted at each end, with the lower end being mounted to a stationary bracket 52 secured to the frame of the apparatus and the upper end being pivotally secured to a level 54 rigidly mounted on trap door 40 so that upon activation of pneumatic cylinder 46 the door 40 will be pivoted about end portion 42.

Extending generally from the lower edge of each sounding board 20 to a position adjacent the edge 44 of trap door 40 when it is in the open position is a flow diverter bar 49 which is slanted towards the opening formed by the open trap door to assist in diverting material flow from the sides of the trap door into the opening. This prevents contaminant material from flowing around the trap door and contaminating the material to be subsequently processed. In addition, it also prevents jamming of the trap door by chips which might otherwise become wedged between the door and the sides.

Figure 4:
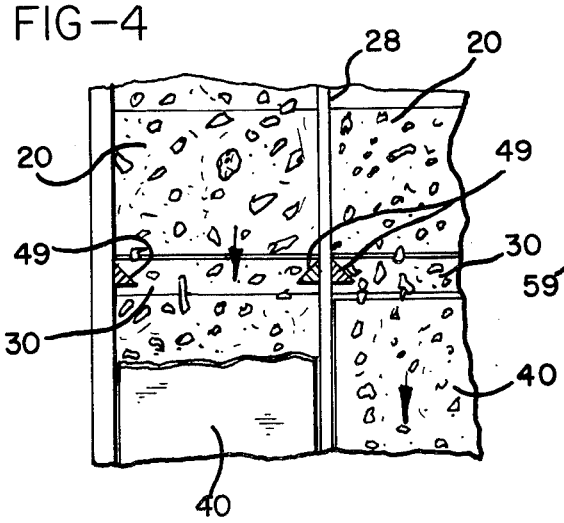
FIG. 4 is an expanded partial cross sectional view of a flow diverter bar positioned adjacent a trap door in the preferred embodiment.

FIG. 4 illustrates a flow diverter bar 49 in expanded cross section. As material flows down along the side of the sounding board 20 adjacent the frame or between adjacent trap doors 40, bars 49 divert the flow into the opening when the trap door is open.

Immediately below trap door 40 in the normal flow path A of material 10 when the trap door 40 is closed, is a stationary plate 56 which is also slanted to permit the material to flow over its surface due to gravity and which directs the material out through the outlet opening 57 defined in the bottom of the apparatus where the process material is collected by collection box 22 for subsequent processing.

It is to be noted that in the downwardly sloping sequence of each sounding board 20, stationary member 30, trap door 40 and stationary plate 56 they are all disposed substantially parallel to one another but in separate planes such that the flow of material 10 tends to cascade from one surface to the next adjacent downstream surface. This aids in preventing material 10 from being deposited in the joints between adjacent members which would disrupt the flow path.

When trap door 40 is positioned in the open position, as indicated in phantom lines in FIG. 1, in order to divert the material along flow path B the material will deposited in a trough at the bottom of which is positioned a screw member 58. Screw member 58 moves the contaminant material and that portion of the chips which have also been removed from the main flow path, laterally to one side of the machine where it is collected in collection box 24. A motor and gear drive arrangement shown generally at 59 drives the screw member 58 so as to remove the contaminant material from the apparatus into the collection box 24.

Referring again to FIG. 1, since the material being deposited by conveyor 12 on each sounding board 20 has a tendency to bounce when it is dropped from above a certain elevation, a hinged baffle plate 60 is provided which causes material to be returned to the sounding board upstream of the position of the trap door 40 so that material will not bypass the trap door. The baffle plate 60 extends across the entire width of the apparatus and is hingedly secured at 62 to bracket 64 which in turn is rigidly supported by the frame work of the apparatus.

Baffle plate 60 is provided in order to intercept rocks and other material that might bounce off the sounding board with a trajectory which would carry them over the trap door. It is hinged in order that a large object, such as a tree limb or a mass of chips, can push it aside rather than jam the trap door or the flow of material. Also, a diverting plate 66 is provided in the opening 14 to initially direct the flow of material 10 from the conveyor 12 onto the sounding boards 20.

Figure 5A:
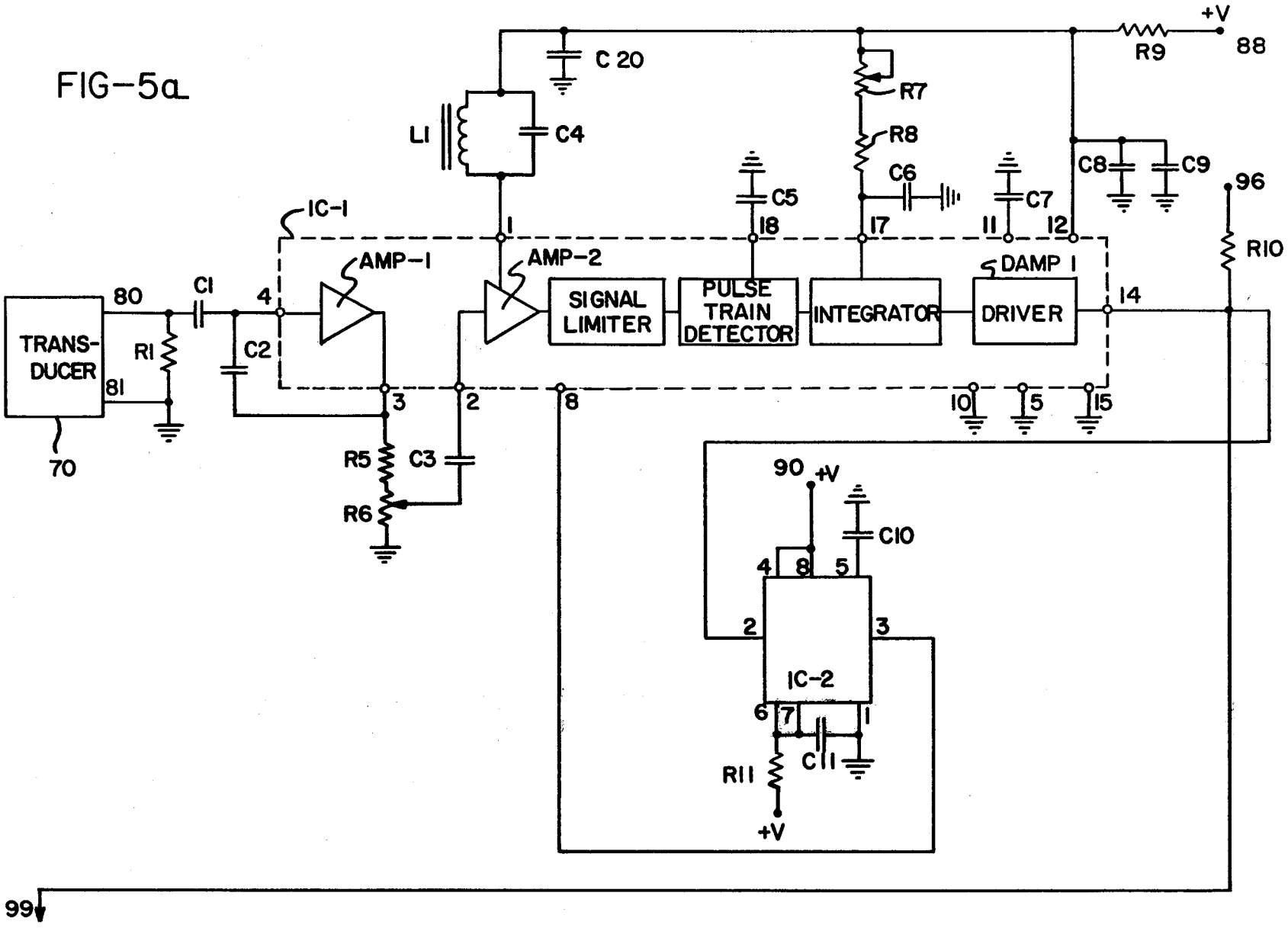

In order to operate the trap doors 20 at the proper time an electrical control circuit is provided which is activated by a transducer 70 secured to the back side of each of the sounding boards 20. A separate circuit, as illustrated in FIGS. 5*a* and 5*b*, is associated with each of these transducers so as to separately operate the respective pneumatic cylinders 46 associated with each trap door 40. A single transducer and control circuit for a single trap door will be described below and it is to be understood that the circuit is the same for each trap door extending across the width of the apparatus.

The transducer 70 is preferably a piezoelectric transducer of sufficiently high natural frequency, e.g., 20–40 kHz, to pick up the vibrations in the sounding board due to impingement of the material thereon. The transducer is connected by line 72 to the control circuit mounted in box 74 on the back of the frame of the apparatus.

Referring more specifically to FIG. 5*a*, the transducer input is received by the circuit at points 80 and 81. This input is capacitor coupled to capacitor C1 to the remainder of the circuit since the AC component is the only portion of the signal from the transducer which is utilized in the circuit. Capacitor C1 provides an input voltage signal to a first stage amplifier AMP-1 which provides an initial amplification of the signal. AMP-1 is coupled in parallel with capacitor C2 in order to prevent oscillation of the circuit. AMP-1 is coupled to a second stage amplifier AMP-2 through resistors R-5 and R-6 and capacitor C3 which coupling provides a means of adjustment of attenuation for AMP-2.

Amplifier AMP-2 is provided with a tuned circuit comprising inductor L-1 and capacitor C-4 which permits amplifier AMP-2 to be tuned to the natural frequency of the transducer. This portion of the circuit acts as a band pass filter which produces a signal output only at around the natural frequency of the transducer.

Amplifier AMP-2 provides an amplified output voltage to a signal limiter which limits the amplitude of the sinusoidal wave from the amplifier AMP-2 to produce a square wave signal. The signal limiter is in turn coupled to a pulse train detector and integrator circuit which together require a predetermined number of pulses to be received from the signal limiter before producing an output signal to a driver amplifier DAMP-1. Resistors R7 and R8 provide control over the number of pulses required in order to produce an output signal from the pulse train detector and integrator circuit.

Those portions of the above described circuit which are contained within the dotted line block in FIG. 5*a* designated IC-1 can be provided by an integrated circuit such as is commercially available from National Semiconductor Corp, Santa Clara, Calif., and designated by part number LM1812. The appropriate pin connection numbers are shown on IC-1 in FIG. 5*a*.

Referring again to the circuit illustrated in FIG. 5*a*, the driver DAMP-1 upon receipt of a signal from the integrator in turn produces a signal to trigger timers IC-2 and IC-3. IC-2 is a timer which can be provided by an integrated circuit such as an NE555 available from Signetics Corp. Sunnyvale, Calif., which in connection with resistor R11 and capacitor C11 provides an adjustable signal output of the desired duration. This signal output from IC-2 can optionally be utilized to inhibit further signal output from IC-1 during activation of the trap door 40 in order to prevent the circuit from being retriggered while it is already operating which could otherwise cause jamming of the door. This is accomplished by connecting the output of IC-2 to pin 8 of the previously designated integrated circuit used for IC-1.

The signal from the driver output of IC-1 is also provided to timer IC-3 which can be an integrated circuit such as an NE555 which also provides a time delay that can be varied in duration by adjusting the resistors R-14 and R-15. IC-3 is used to delay opening of trap door 40 for a sufficient period of time to permit the contaminant material to slide from the sounding board to a position immediately upstream of the trap door before the trap door is opened so that an unnecessary amount of uncontaminated material is not lost by the trap door being prematurely opened.

IC-3 is coupled through capacitor C-14 to another timer IC-4 which is also a time delay mechanism such as an integrated circuit NE555 that can also be adjusted for the desired time delay by resistances R18 and R19. IC-4 is intended to provide the output signal which activates solenoid valve 50 to provide air to pneumatic cylinders 46 that operate the trap door 40. IC-4 maintains the trap door open for the desired period of time. After the period of time has elapsed solenoid valve 50 is released and the trap door is closed by the double acting pneumatic cylinder 46.

The power inputs to IC-2, 3 and 4 as well as the output from driver amplifier DAMP-1 are all maintained at a positive voltage level which is supplied by a power supply (not shown). A positive voltage output from the power supply is also provided to terminals 88. 90, 92 and 94.

This voltage supply normally maintains a positive potential output for driver amplifier DAMP-1 and a positive potential input on IC-2, 3 and 4. Since NE555 integrated circuits are trailing edge activated, i.e., they will be activated by a negative going pulse or by the decrease in positive voltage, the signal generated by driver amplifier DAMP-1 is a negative going pulse of short duration. The trailing edge of this pulse triggers IC-2 and IC-3 simultaneously which results in a positive output from IC-2 and IC-3 at the level of the input voltage of pins 90 and 92. The decreasing voltage then produced by turning off IC-3 after the predetermined time will activate IC-4 which in turn operates the solenoid valve 50 as mentioned above.

Thus, it can be seen that in operation of the device when material 10 to be sorted is delivered from conveyor 12 to sounding board 20 it will be vibrated so as to produce an output from the transducer 70. When a piece of metal or rock impacts the surface of sounding board 20 a signal of substantially greater amplitude is produced as well as a series of such signals of greater duration, than is produced by impact of wood chips on the sounding board. These signals of higher amplitude operate the circuit illustrated in FIGS. 5*a* and 5*b* as described above in order to activate trap door 40 through the pneumatic cylinders 46.

Although the preferred embodiment is described as utilizing a conveyor 12 which drops the material to be sorted onto the sounding board 20 slanted at an acute angle to the direction of approach of the material on the conveyor, it is to be understood that the angle of the sounding board and the direction of slant relative to the delivery means is not intended to be limited. For example, it has been discovered that when a relatively thick layer of material is to be delivered by the delivery means, the present invention is more efficient if the sounding board is slanted at an obtuse angle to the direction of approach of the material on the conveyor since the contaminant material such as rocks and metal which are heavier have a tendency to fall faster than the wood chips so that they impinge upon the sounding board before the chips rather than landing on top of the chips as may occur with the sounding board is positioned as illustrated in the preferred embodiment. This is only true where the thickness of a layer of material being delivered is such that a substantial layer of chips may be deposited on the sounding board prior to impingement of the contaminant material thereon so as to act as a vibration insulator between the contaminant materials and the sounding board.

Furthermore, it is to be understood that the positioning of the sounding board relative to the means for delivering the material to be sorted need not be exactly as illustrated in the preferred embodiment. For example, it is contemplated that the material could be ballistically directed upwards towards a sounding board disposed in the normal trajectory of the material. In addition, it is contemplated that some means other than the trap door provided in the preferred embodiment could be utilized for diverting the normal path of movement of the contaminant material after it has impacted the sounding board.

While the method herein described, and the form of apparatus for carrying this material into effect, constitute preferred embodiments of the invention, it is to be understood that the invention is not limited to this precise method and form of apparatus, and that changes may be made in either without departing from the scope of the invention.

What is claimed is:

1. An apparatus for sorting contaminant material such as rocks and metal from processing material such as wood chips, mixed to form a continuous layer of material, comprising:

means for impinging a layer of material on a surface which can be vibrated thereby;

means for sensing vibrations of said surface;

means for generating signals corresponding to said vibrations;

means for distinguishing between signals generated in response to impact of said processing material from response to impact of said contaminant material including means for distinguishing between the amplitudes and durations of vibration of said surface caused respectively by said processing material and said contaminant material;

material flow diverting means activated only in response to a signal generated by impact of said contaminant material on said surface, so as to divert the flow of a portion of said layer of material containing said contaminant material from the normal flow path of said layer of material; and means for deactivating said material flow diverting means after said portion of material has been diverted, so that said layer of material subsequent to said portion returns to the normal flow path.

2. An apparatus as defined in claim 1 wherein said material flow diverting means comprises trap door means disposed downstream of said surface in the normal flow path of said layer of material which is activated in response to the signal from said signal distinguishing means generated in response to said input of said contaminant material on said surface.

3. A sorting apparatus for sorting contaminant materials such as rocks and metal from processing materials such as wood chips and the like, comprising:

material receiving means having a surface portion for receiving a layer of material including both said contaminant and said processing materials;

materials delivery means for impingingly depositing said layer of material on said surface position;

sensing means engaging said surface portion for sensing vibration of said surface portion due to impingement of said layer of material thereon and for generating signals in response thereto;

signal discriminating means for receiving said signals generated by said sensing means and distinguishing between signals produced by impingement of said contaminant material from those produced by impingement of said process material on said surface portion, and for passing only signals produced by impingement of said contaminant material, said signal discriminating means including means for distinguishing between the amplitudes and durations of vibration of said surface portion caused respectively by said processing material and said contaminant material;

trap means downstream in the movement of said layer of material from said surface portion and movable between an inoperative position in which said layer of material flows in a normal flow path past said trap means to an operative position for diverting from said normal flow path a portion of said layer of material containing said contaminant material; and activating means for receiving said signal passed from said signal discriminating means and for activating said trap means to move from said inoperative position to said operative position in response thereto and for further causing said trap means to move from said operative position to said inoperative position after sufficient time to permit said contaminant material to be diverted.

4. Apparatus as defined in claim 3 wherein said sensing means includes a transducer means for sensing vibrations of said surface portion of said receiving means due to impingement of said layer of material thereon and for sending continuous signals to said signal discriminating means, said transducer means being sufficiently sensitive to produce different amplitude signal outputs in response to differences in amplitude of vibration of said surface portion due to impingement of said contaminant material or said process material thereon.

5. Apparatus as defined in claim 4 wherein said signal discriminating means includes:

means for preventing passage of signals below a predetermined threshold amplitude and for passing those above said threshold amplitude; and means for sensing the output signals from said passage preventing means and for providing an output signal upon sensing of both, (a) a further predetermined amplitude of signal and (b) a predetermined duration of a plurality of said further predetermined amplitude of signals.

6. Apparatus as defined in claim 5 wherein said activating means includes:

first time delay means for delaying initiation of movement of said trap means from said inoperative position to said operative position for a time sufficient to permit said contaminant material to move from where it impinges on said material receiving means to a position immediately upstream of said trap means;

second time delay means for maintaining said trap means in said operative position for sufficient time to permit said contaminant material to be diverted from said normal flow path.

7. Apparatus as defined in claim 6 including means for preventing a signal output from said discriminating means to said activating means while said top means is in said operative position.

8. Apparatus as defined in claim 3 wherein said transducer means is disposed on a surface of said receiving means opposite said surface portion thereof which receives said layer of material.

9. Apparatus as defined in claim 8 including material delivery means comprising a conveyor having a delivery portion superposed in spaced relation above said surface portion of said receiving means so that said layer of material drops onto said surface portion.

10. Apparatus as defined in claim 8 wherein said surface portion of said material receiving means includes a flat surface inclined sufficiently to cause said layer of material to slide downwardly therealong towards said trap means.

11. Apparatus as defined in claim 5 wherein said trap means includes:

a plate disposed at the lower most end portion of said inclined flat surface of said receiving means in substantially the same plane containing said surface;

hinge means securing a lower end portion of said plate to said apparatus for upward pivotal movement of said plate into the normal flow path of said layer of material; and actuator means operative to pivot said plate about said hinge means between said operative and inoperative positions of said trap means.

12. A method of sorting contaminant material such as rocks and metal from processing materials such as wood chips mixed to form a continuous layer of material, comprising the steps of:

impingingly striking a layer of material on a surface which can be vibrated thereby;

sensing vibrations of said surface;

generating signals corresponding to said vibrations;

distinguishing between signals generated in response to impact of said processing materials from response to impact of said contaminant material by distinguishing between both the amplitudes and durations of vibration of said surface caused respectively by said processing material and said contaminant material;

activating a material flow diverting means only in response to a signal generated by impact of said contaminant material on said surface, so as to divert the flow of a portion of said layer of material containing said contaminant material from the normal flow path of said layer of material; and deactivating said material flow diverting means after said portion of material has been diverted, so that said layer of material subsequent to said portion returns to the normal flow path.

13. A method as defined in claim 12 wherein said step of activating a material flow diverting means is delayed for a time sufficient to permit said portion of material containing said contaminant to move from said surface to said flow diverting means.

* * * * *

UNITED STATES PATENT AND TRADEMARK OFFICE

CERTIFICATE OF CORRECTION

PATENT NO. : 4,147,620

DATED : April 3, 1979

INVENTOR(S) : Adrian Artiano, Darrell N. Halgrimson, Henry W. Joselovitz

It is certified that error appears in the above-identified patent and that said Letters Patent are hereby corrected as shown below:

Column 2, line 56, "plat" should be --plate--.

Column 4, line 40, "if" should be --it--.

Column 6, line 9, first occurrence, "to" should be --by--.

Column 7, line 67, "in-pingement" should be --im-pingement--.

Column 8, line 63, "materials" should be --material--.

Signed and Sealed this

*Thirty-first* Day of *July 1979*

[SEAL]

*Attest:*

*Attesting Officer*

LUTRELLE F. PARKER

*Acting Commissioner of Patents and Trademarks*

UNITED STATES PATENT AND TRADEMARK OFFICE

CERTIFICATE OF CORRECTION

PATENT NO. : 4,147,620

DATED : April 3, 1979

INVENTOR(S) : Adrian Artiano et al.

It is certified that error appears in the above-identified patent and that said Letters Patent are hereby corrected as shown below:

Column 8, line 64, "position" should read -- portion --.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*